US012649085B2

(12) United States Patent
Han et al.

(10) Patent No.: US 12,649,085 B2
(45) Date of Patent: Jun. 9, 2026

(54) MULTIFUNCTIONAL SLIDING STORAGE TREADMILL

(71) Applicant: Beijing Yihai Technology Co., Ltd., Beijing (CN)

(72) Inventors: Yunhai Han, Beijing (CN); Anqi Gong, Nanping (CN); Hao Tian, Cangzhou (CN)

(73) Assignee: Beijing Yihai Technology Co., Ltd., Beijing (CN)

( * ) Notice: Subject to any disclaimer, the term of this patent is extended or adjusted under 35 U.S.C. 154(b) by 102 days.

(21) Appl. No.: 18/800,715

(22) Filed: Aug. 12, 2024

(65) Prior Publication Data

US 2026/0014415 A1 Jan. 15, 2026

(30) Foreign Application Priority Data

Jul. 15, 2024 (CN) ..... 202410943715.4

(51) Int. Cl.
*A63B 22/02* (2006.01)
*A63B 21/00* (2006.01)

(52) U.S. Cl.
CPC ..... *A63B 22/0235* (2013.01); *A63B 21/154* (2013.01); *A63B 2210/52* (2013.01)

(58) Field of Classification Search
CPC .. A63B 22/0235; A63B 21/15; A63B 2210/05
See application file for complete search history.

(56) References Cited

U.S. PATENT DOCUMENTS 6,090,016 A * 7/2000 Kuo ..... A63B 22/02 482/54
6,383,120 B1 * 5/2002 Lo ..... A63B 22/02 482/54
6,857,991 B2 * 2/2005 Yu ..... A63B 22/02 482/54
6,890,287 B2 * 5/2005 Chen ..... A63B 22/02 482/54
6,916,277 B2 * 7/2005 Chen ..... A63B 22/02 482/54

(Continued)

FOREIGN PATENT DOCUMENTS

WO WO-2020211386 A1 * 10/2020 ..... A63B 22/02

*Primary Examiner* — Garrett K Atkinson
(74) *Attorney, Agent, or Firm* — Birchwood IP

(57) ABSTRACT

The invention discloses a multifunctional sliding storage treadmill, comprising the frame and the armrest. The frame comprises the fixed frame and the sliding frame, and there is a traction mechanism provided between them. The tensioning mechanism is provided at the bottom of the sliding frame, and the traction mechanism comprises the first motor, the transmission belt, the guide pulley, the first traction block, the connecting rod, and the second traction block. The first motor, transmission belt, guide pulley, and the first traction block are installed in the fixed frame, and the second traction block is movable installed in the sliding frame. The invention has the advantage of easy storage and good stability of the device, which solves the problems of inconvenient storage operation, cumbersome operation and affecting storage efficiency, and poor stability at the connection of the folding running joint in the prior art folding treadmills.

8 Claims, 8 Drawing Sheets

(56) References Cited

U.S. PATENT DOCUMENTS

| | | | | |
|---|---|---|---|---|
| 6,923,747 | B1 * | 8/2005 | Chu | A63B 22/02 482/54 |
| 6,979,283 | B2 * | 12/2005 | Pan | A63B 22/02 482/54 |
| 7,004,887 | B2 * | 2/2006 | Pan | A63B 22/02 482/54 |
| 7,780,578 | B2 * | 8/2010 | Packham | A63B 22/02 482/4 |
| 10,589,147 | B1 * | 3/2020 | Kostadis | A63B 22/025 |
| 2004/0132585 | A1 * | 7/2004 | Chen | A63B 22/02 482/54 |
| 2004/0248699 | A1 * | 12/2004 | Colley | A63B 22/02 482/54 |
| 2008/0234111 | A1 * | 9/2008 | Packham | A63B 22/02 482/54 |
| 2008/0280734 | A1 * | 11/2008 | Dickie | A63B 22/0023 482/54 |
| 2009/0005224 | A1 * | 1/2009 | Davis | A63B 22/0257 482/54 |
| 2009/0062072 | A1 * | 3/2009 | Packham | A63B 22/02 482/4 |
| 2009/0181830 | A1 * | 7/2009 | Wu | A63B 22/001 482/54 |
| 2015/0351553 | A1 * | 12/2015 | Herring | A47C 7/006 108/50.11 |
| 2018/0221707 | A1 * | 8/2018 | Weaver | A63B 22/02 |
| 2020/0215380 | A1 * | 7/2020 | Xing | A63B 22/025 |
| 2021/0299512 | A1 * | 9/2021 | Kostadis | A63B 22/025 |

* cited by examiner

MULTIFUNCTIONAL SLIDING STORAGE TREADMILL

CROSS-REFERENCE TO RELATED APPLICATIONS

This application claims priority to Chinese Patent Application No. 202410943715.4, filed on Jul. 15, 2024 and Chinese Patent Application No. 202421769206.6, filed on Jul. 25, 2024, which is hereby incorporated by reference in its entirety.

TECHNICAL FIELD

The invention relates to the field of treadmill technology, specifically a multifunctional sliding storage treadmill.

BACKGROUND

Due to the improvement of people's health awareness and changes in lifestyle, the home-oriented fitness equipment market is becoming increasingly prosperous. Among them, the treadmill, as one of the most popular fitness equipment, is deeply loved by consumers due to its convenient and fast characteristics. However, traditional treadmills have problems such as large size, large space occupation, and inconvenient storage. For urban residents with limited living space, these drawbacks have become the main obstacles to choosing treadmills.

There have been various attempts in the market, to improve the situation, such as the invention of the folding treadmill. However, there is still room for improvement in terms of storage convenience and maintaining the tension of the running belt. In particular, existing folding treadmills often have complex folding mechanisms, inconvenient operation, and the running belt is prone to slack or become too tight in the folded state, affecting the service life of the running belt. After the device is unfolded, the stability of the connection is poor. Therefore, a multifunctional sliding storage treadmill is needed to solve the above problems.

SUMMARY

The invention is invented to provide a multifunctional sliding storage treadmill, which has the advantage of easy storage and good stability of the device, and solves the problems of inconvenient storage operation, cumbersome operation and affecting storage efficiency, and poor stability of the connection of the folding running joint in the prior art folding treadmills.

To achieve the above goals, the following technical solution is provided: a multifunctional sliding storage treadmill, comprising the frame and armrest. The frame comprises the fixed frame and the sliding frame, and there is a traction mechanism is provided between them. And a tensioning mechanism is provided at the bottom of the sliding frame;

The traction mechanism comprises the first motor, the transmission belt, the guide pulley, the first traction block, the connecting rod, and the second traction block. The first motor, transmission belt, guide pulley, and first traction block are installed in a fixed frame, and the second traction block is movable and installed in the sliding frame. The first traction block and the second traction block are connected by the connecting rod;

The tensioning mechanism comprises the tensioning roller, the guide rod, the first slider, and the first spring, and it is installed at the lower end of the sliding frame.

As a preferred multifunctional sliding storage treadmill of the invention, the side wall chambers of the fixed frame and sliding frame are provided with equipment chambers, and the guide pulley is installed in the equipment chamber and rotationally connected to the fixed frame. The first motor is connected to the guide pulley through the synchronous wheel and the synchronous belt, and the transmission belt is sleeved on the guide pulley. The first traction block is fixedly installed on the transmission belt, and the upper end surface of the fixed frame is provided with a guide groove. The connecting rod passes through the guide groove and is slidably connected to the fixed frame.

As a preferred multifunctional sliding storage treadmill of the invention, the second sliding groove is provided in the side wall of the sliding frame, and the second spring is provided in the second sliding groove. The second traction block is installed in the second sliding groove and is elastically slidably connected to the sliding frame through the second spring.

As a preferred multifunctional sliding storage treadmill of the invention, the lower end of the sliding frame is provided with the pulley, which is set at the inflection point of the lower end surface of the sliding frame, and the front end surface of the fixed frame is a 45 degree inclined surface structure.

As a preferred multifunctional sliding storage treadmill of the invention, the inner end surface of the fixed frame is equipped with the electromagnetic lock, and the rear end surface of the sliding frame is equipped with a lock head that cooperates with the electromagnetic lock.

As a preferred multifunctional sliding storage treadmill of the invention, the fixed frame is equipped with the first running platform, and the sliding frame is equipped with the second running platform. The first and second running platforms are equipped with running belts, and the tensioning mechanism is installed at the lower end of the second running platform. The running belt passes through the upper end surface of the tensioning roller and is rotationally connected to it.

As a preferred multifunctional sliding storage treadmill of the invention, the guide rod is fixedly installed on the lower end surface of the second running table, the first slider and the first spring are slidably connected to the guide rod, and the left and right ends of the tensioning roller are rotationally connected to the first slider.

As a preferred multifunctional sliding storage treadmill of the invention, the bottom of the fixed frame is provided with the rotating support rod, and the upper end surface of the support rod is provided with the movable hydraulic telescopic rod, which is rotationally connected to the bottom of the fixed frame.

Compared with the existing technology, the beneficial effects of the invention are as follows:

1. The invention drives the guide pulley through the first motor, and then drives the sliding frame to slide along the fixed frame through the synchronous belt and traction mechanism, ultimately achieving the folding and storage of the equipment. This design greatly reduces the footprint of the treadmill when it is not in use. When connected to the controller of the treadmill, the one-click storage box can be unfolded, greatly improving the convenience of operation. The guide pulley and the pulley set at the lower end of the sliding frame jointly reduce the friction during the sliding process, ensuring smooth and low-noise sliding, further improving the convenience of the storage process. When fully unfolded or stored in place, the electromagnetic lock and lock head automatically cooperate and fix, not only simplifying the operation steps, but also ensuring stability and safety during the movement process, avoiding the risk of accidental movement of the equipment.

2. The invention ensures that during the movement of the sliding frame, the tensioning mechanism can automatically adjust the tension level of the running belt according to the position change of the sliding frame by combining the tensioning roller, guide rod, first slider, and first spring, avoiding the situation of relaxation or excessive stretching of the running belt during storage or unfolding. The service life of the running belt ensures the optimal performance of the equipment in any state.

3. The invention is also equipped with adjustable support rods and hydraulic telescopic rods, allowing users to adjust the tilt angle of the treadmill according to personal needs, simulate different exercise scenarios, increase the diversity and fun of training, and the hydraulic adjustment mechanism is safer, more stable, and easy to operate.

In the figures: 1: frame; 101: fixed frame; 1011: running belt; 1012: first running platform; 1013: support rod; 1014: hydraulic telescopic rod; 102: sliding frame; 1021: second sliding groove; 1022: second running platform; 1023: pulley; 103: equipment chamber; 104: guide groove; 2: armrest; 3: traction mechanism; 301: guide pulley; 302: transmission belt; 303: first traction block; 304: connecting rod; 305: second traction block; 306: second spring; 307: electromagnetic lock; 308: lock head; 309: motor; 4: tensioning mechanism; 401: tensioning roller; 402: guide rod; 403: slider; 404: first spring.

DETAILED DESCRIPTION OF THE EMBODIMENTS

Example 1

Figure 1:
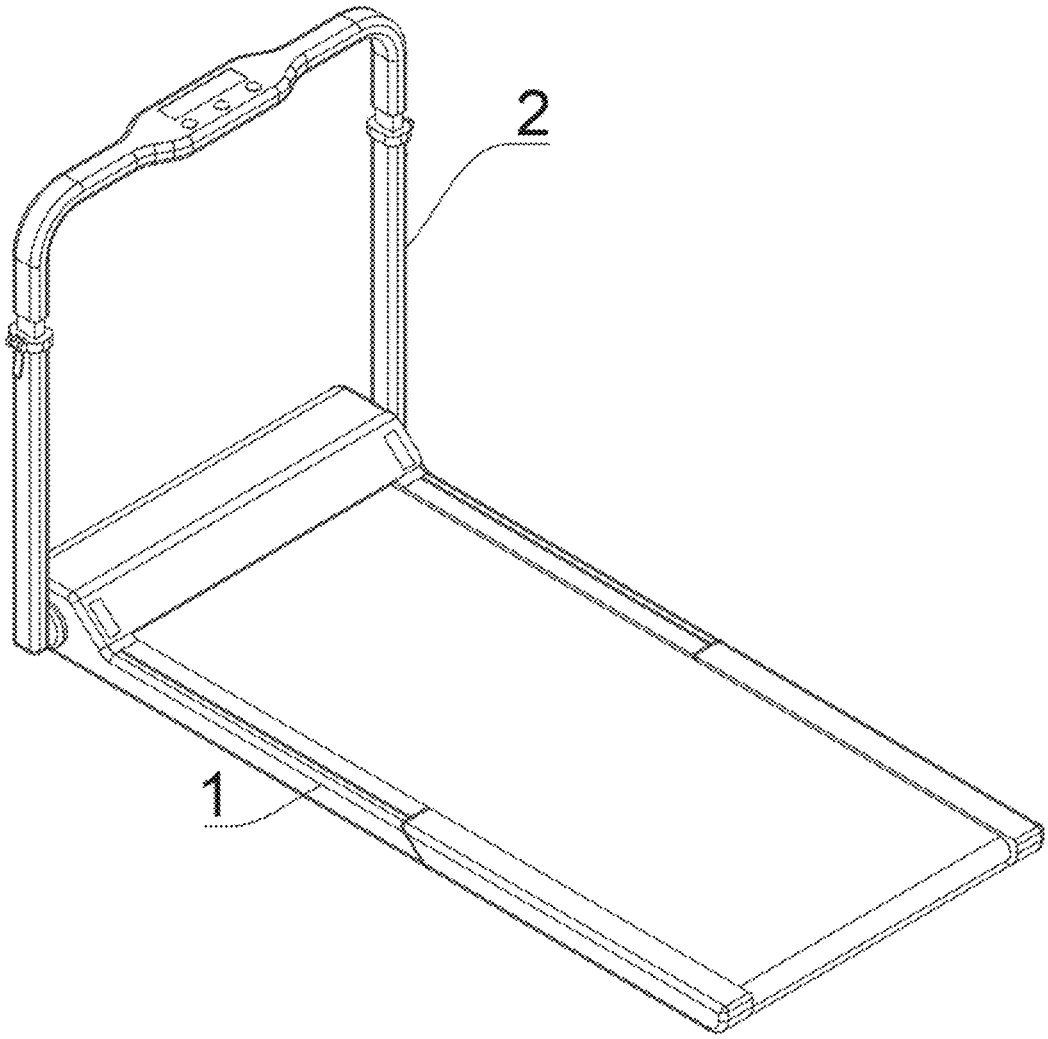
FIG. 1 is the schematic diagram of the overall structure of the invention.
Figure 2:
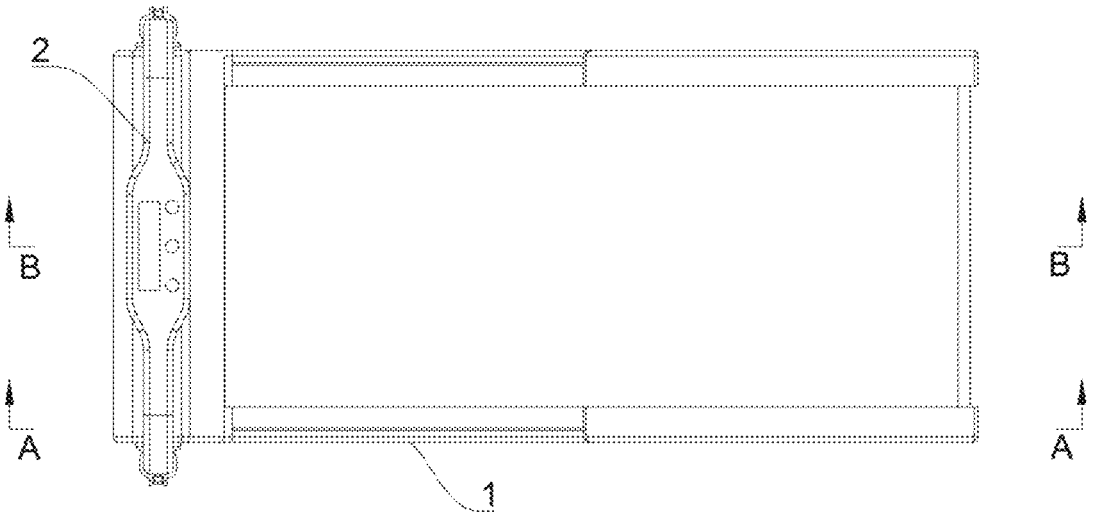
FIG. 2 is the top view of the invention.
Figure 3:
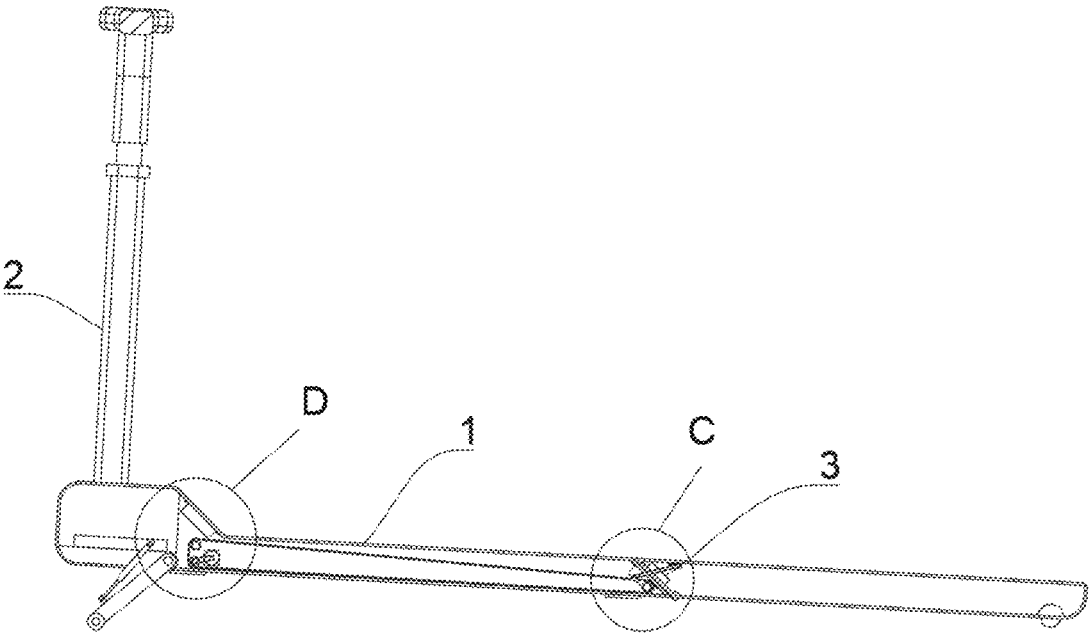
FIG. 3 is the A-A section of FIG. 2 of the invention.
Figure 4:
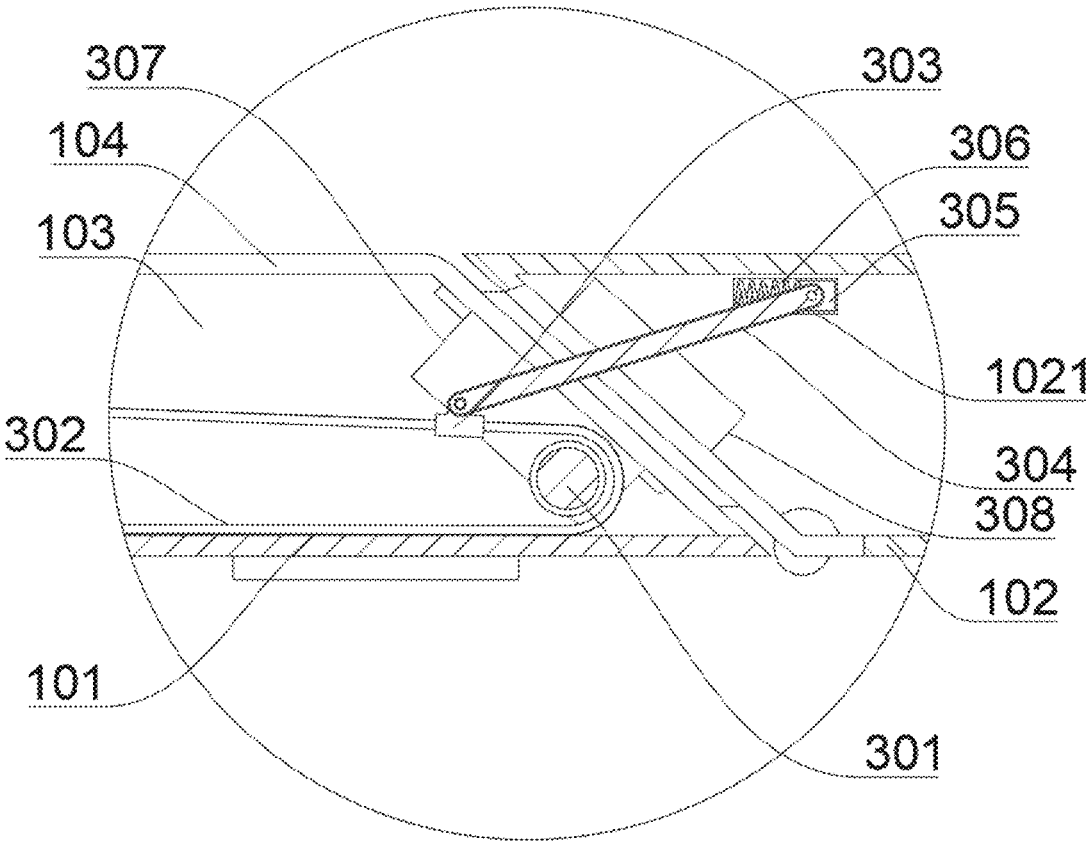
FIG. 4 is the enlarged view of point C in FIG. 3 of the invention.
Figure 5:
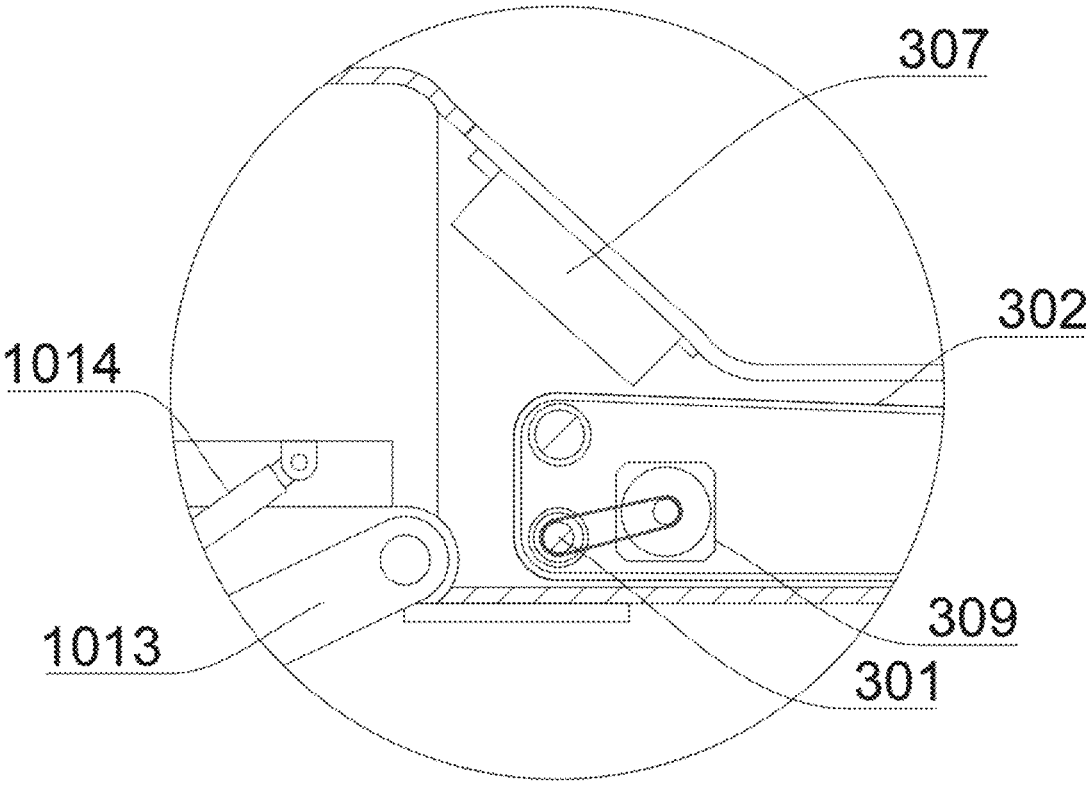
FIG. 5 is the enlarged view of point D in FIG. 3 of the invention.
Figure 6:
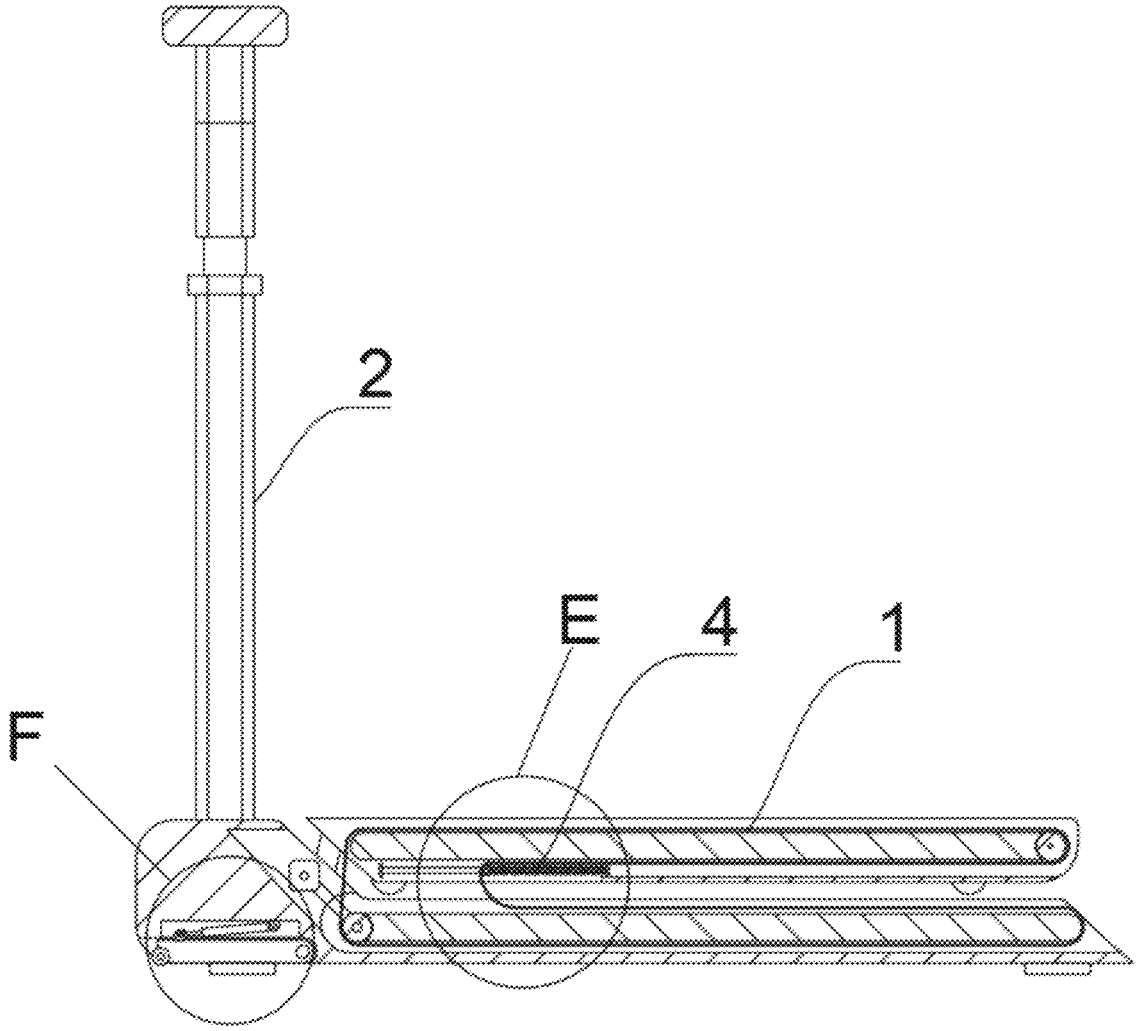
FIG. 6 is the B-B section of FIG. 2 of the invention.
Figure 7:
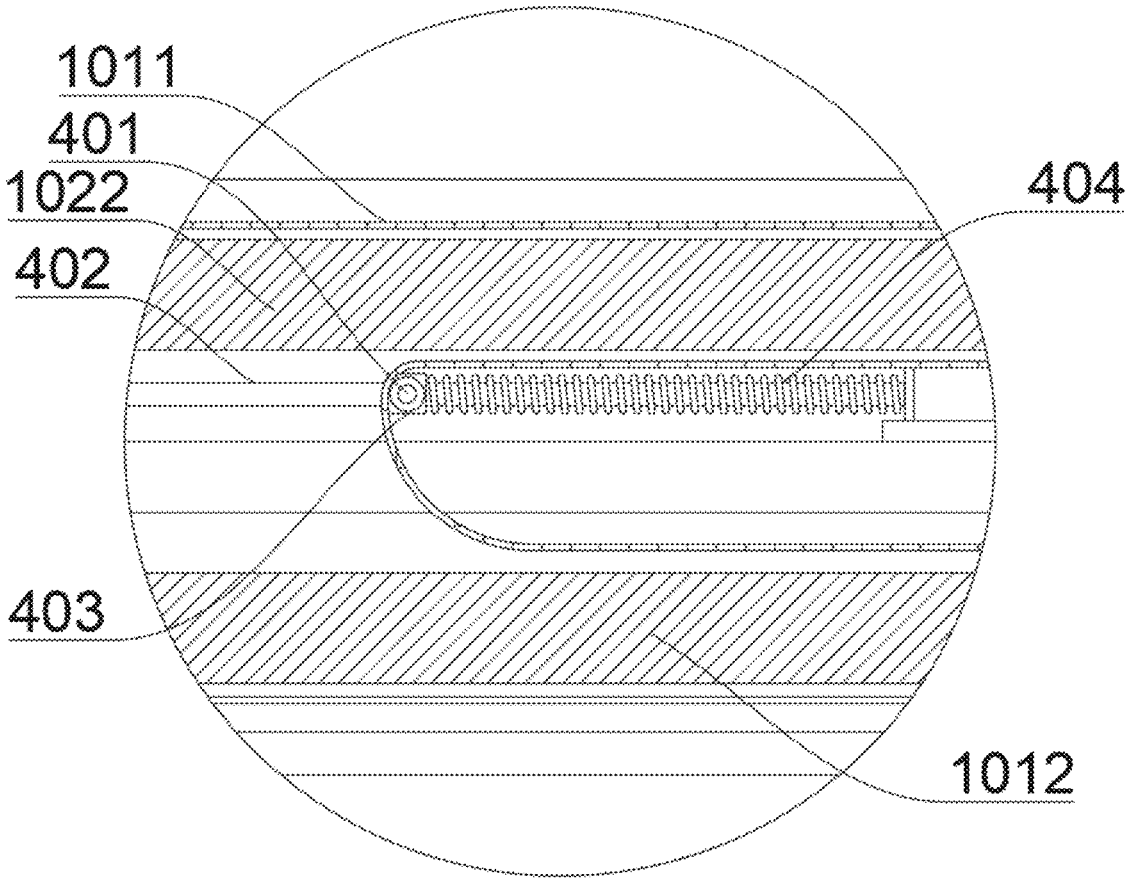
FIG. 7 is the enlarged view of point E in FIG. 6 of the invention.
Figure 8:
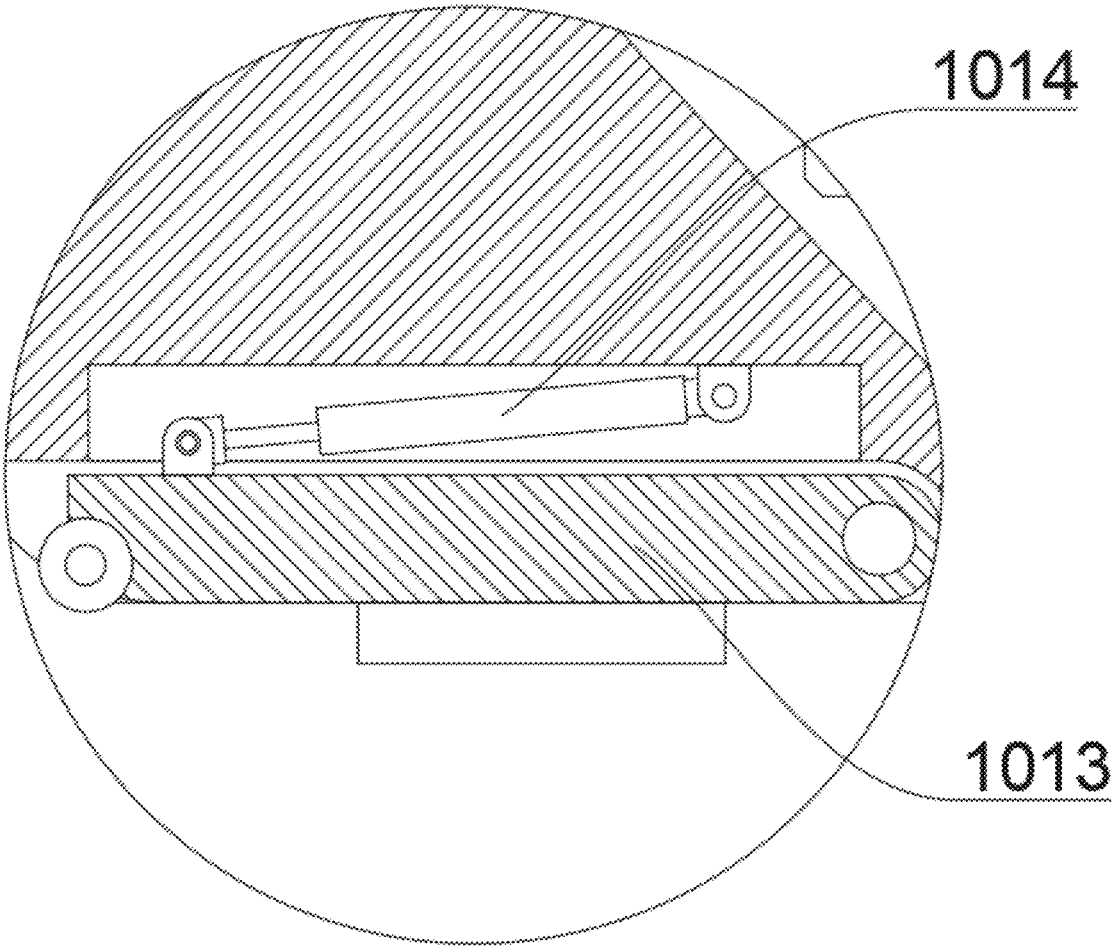
FIG. 8 is the enlarged view of point F in FIG. 6 of the invention.

Please refer to FIGS. 1-7. A multifunctional sliding storage treadmill comprises the frame 1 and the armrest 2. The frame 1 comprises the fixed frame 101 and the sliding frame 102. There is a traction mechanism 3 provided between the fixed frame 101 and the sliding frame 102, and a tensioning mechanism 4 provided at the bottom of the sliding frame 102;

The traction mechanism 3 comprises the first motor 309, the transmission belt 302, the guide pulley 301, the first traction block 303, the connecting rod 304, and the second traction block 305. The first motor 309, transmission belt 302, guide pulley 301, and first traction block 303 are installed in the fixed frame 101, and the second traction block 305 is movable and installed in the sliding frame 102. The first traction block 303 and the second traction block 305 are connected through the connecting rod 304;

The tensioning mechanism 4 comprises the tensioning roller 401, the guide rod 402, the first slider 403, and the first spring 404. The tensioning mechanism 4 is installed at the lower end of the sliding frame 102;

The armrest 2 is equipped with a controller connected to motor 309, electromagnetic lock 307, and hydraulic telescopic rod 1014. The controller controls the operation of each device, allowing for one-click deployment or storage of the equipment.

Furthermore, the side wall chambers of the fixed frame 101 and the sliding frame 102 are equipped with equipment chambers 103. The guide pulley 301 is installed in the equipment chamber 103 and is rotationally connected to the fixed frame 101. The first motor 309 is connected to the guide pulley 301 through a synchronous wheel and a synchronous belt, and the transmission belt 302 is sleeved on the guide pulley 301. The first traction block 303 is fixedly installed on the transmission belt 302. The upper end surface of the fixed frame 101 is provided with a guide groove 104, and the connecting rod 304 passes through the guide groove 104 and is slidably connected to the fixed frame 101.

By driving the guide pulley 301 to rotate through the motor 309, the first traction block 303 of the transmission belt 302 is moved, generating a traction force on the sliding frame 102 and pulling it to the upper end of the fixed frame 101, reducing storage space and facilitating the storage of the treadmill.

Further, the second sliding groove 1021 is provided in the side wall of the sliding frame 102, and a second spring 306 is provided inside the second sliding groove 1021. The second traction block 305 is installed in the second sliding groove 1021 and is elastically slidably connected to the sliding frame 102 through the second spring 306.

The structure of the second traction block 305 with elastic connection allows the existence of the second spring 306 to make the movement of the sliding frame 102 smoother during the traction process of the traction mechanism 3. The elastic connection allows the sliding frame 102 to self-adjust its position within a certain range.

Then, the lower end of the sliding frame 102 is equipped with a pulley 1023, which is located at the inflection point of the lower end surface of the sliding frame 102. The front end surface of the fixed frame 101 has a 45 degree inclined surface structure.

By using the guide pulley 301 to reduce the friction between the fixed frame 101 and the sliding frame 102, the traction resistance can be reduced. Setting the pulley 1023 at the inflection point can reduce the scratching of the sliding frame 102 on the upper end face of the fixed frame 101.

Furthermore, the inner end face of the fixed frame 101 is equipped with an electromagnetic lock 307, and the rear end face of the sliding frame 102 is equipped with the lock head 308 that cooperates with the electromagnetic lock 307.

When the sliding frame 102 slides to full deployment, or when the sliding frame 102 slides above the fixed frame 101, the sliding frame 102 and the fixed frame 101 are fixed by the electromagnetic lock 307 and the lock head 308, thereby preventing the fixed frame 101 and the sliding frame 102 from deviating during movement or storage, which affects the stability of the equipment. When the electromagnetic lock 307 is in place and locked, it can send a signal back to the controller to control the motor 309 to stop.

Furthermore, the fixed frame 101 is equipped with a first running platform 1012, and the sliding frame 102 is equipped with the second running platform 1022. The first running platform 1012 and the second running platform 1022 are equipped with the running belt 1011, and the tensioning mechanism 4 is installed at the lower end of the second running platform 1022. The running belt 1011 is rotationally connected with the upper face of the tensioning roller 401.

During the sliding and storage process of the treadmill, the running belt 1011 may become loose. The tensioning roller 401 is set at the lower end of the second running platform 1022, so that during the sliding process of the sliding frame 102, the tensioning roller 401 can tension the non-running belt.

Furthermore, the guide rod 402 is fixedly installed on the lower end surface of the second running platform 1022, and the first slider 403 and the first spring 404 are sleeved on the guide rod 402 and connected to it for sliding. The left and right ends of the tensioning roller 401 are rotationally connected to the first slider 403.

During the storage process of the treadmill, the running belt 1011 is folded and stored between the activity price and the fixed frame 101 under the action of the tensioning roller 401. The tensioning roller 401 returns to the first spring 404, keeping the running belt 1011 taut and preventing the running belt 1011 from falling off after storage.

Furthermore, the bottom of the fixed frame 101 is equipped with a rotating connection of the support rod 1013, and the upper end surface of the support rod 1013 is equipped with a movable hydraulic telescopic rod 1014, and the hydraulic telescopic rod 1014 is rotationally connected to the bottom of the fixed frame 101.

By controlling the extension length of the hydraulic telescopic rod 1014, the inclination angle of the treadmill can be adjusted to achieve climbing function.

When this treadmill is used, turn on the power and start the device through the control panel. At this time, the electromagnetic lock 307 will automatically unlock, and the motor 309 will drive the transmission belt 302 to move. The first traction block 303 on the transmission belt 302 cooperates with the second traction block 305 through the connecting rod 304, dragging the sliding frame 102 to slide smoothly along the guide track of the fixed frame 101 until the sliding frame 102 is fully unfolded and located in front of the fixed frame 101. When the sliding frame 102 is fully unfolded, the electromagnetic lock 307 will automatically lock again to ensure the stability of the device. Use the control panel to adjust the support rod 1013 and hydraulic telescopic rod 1014 to change the inclination angle of the treadmill, in order to increase exercise intensity or simulate different terrain conditions.

The above are only the preferred embodiments of the invention and are not intended to limit the invention. Any modifications, equivalent substitutions, and improvements made within the spirit and principles of the invention should be included within the scope of protection of the invention.

What is claimed is:

1. A multifunctional sliding storage treadmill, comprising: a frame and an armrest (2), wherein the frame comprises a fixed frame and a sliding frame, a traction mechanism is provided between the fixed frame and the sliding frame, and a tensioning mechanism is provided at a bottom of the sliding frame;

the traction mechanism comprises a first motor, a transmission belt, a guide pulley, a first traction block, a connecting rod, and a second traction block;

wherein the first motor, the transmission belt, the guide pulley, and the first traction block are installed in the fixed frame, and the second traction block is installed in the sliding frame;

wherein the first traction block and the second traction block are connected through the connecting rod;

the tensioning mechanism comprises a tensioning roller, a guide rod, a first slider, and a first spring, and is installed at a lower end of the sliding frame.

2. The multifunctional sliding storage treadmill as claimed in claim 1, wherein the side wall chambers of the fixed frame and the sliding frame are provided with equipment chambers, the guide pulley is installed in the equipment chambers and connected to the fixed frame, the first motor and the guide pulley are connected by synchronous wheels and synchronous belts, the transmission belt is sleeved on the guide pulley, the first traction block is fixedly installed on the transmission belt, an upper end face of the fixed frame is provided with a guide groove, and the connecting rod is connected with the fixed frame through the guide groove.

3. The multifunctional sliding storage treadmill as claimed in claim 1, wherein a second sliding groove is provided in a side wall of the sliding frame, and a second spring is provided in the second sliding groove, wherein the second traction block is installed in the second sliding groove and is connected to the sliding frame through the second spring.

4. The multifunctional sliding storage treadmill as claimed in claim 1, wherein a lower end of the sliding frame is provided with a pulley, the pulley is set at an inflection point of a lower end surface of the sliding frame, and a front end surface of the fixed frame is a 45 degree inclined surface structure.

5. The multifunctional sliding storage treadmill as claimed in claim 1, wherein an inner end surface of the fixed frame is provided with an electromagnetic lock, and a rear end surface of the sliding frame is provided with a lock head that cooperates with the electromagnetic lock.

6. The multifunctional sliding storage treadmill as claimed in claim 1, wherein a first running platform is provided on the fixed frame, a second running platform is provided on the sliding frame, running belts are provided on the first running platform and the second running platform, the tensioning mechanism is installed at a lower end of the second running platform, and the running belts are connected with an upper end face of the tensioning roller.

7. The multifunctional sliding storage treadmill as claimed in claim 6, wherein the guide rod is fixedly installed on a lower end surface of the second running platform, the first slider and the first spring are sleeved on the guide rod, and left and right ends of the tensioning roller are rotationally connected to the first slider.

8. The multifunctional sliding storage treadmill as claimed in claim 1, wherein a bottom of the fixed frame is provided with a support rod, and an upper end surface of the support rod is provided with a movable hydraulic telescopic rod, and the movable hydraulic telescopic rod is connected to the bottom of the fixed frame.

* * * * *